US005411255A

United States Patent [19]

Kurashima et al.

[11] Patent Number: 5,411,255

[45] Date of Patent: May 2, 1995

[54] GOLF CLUB HEAD

[75] Inventors: Takao Kurashima; Takeshi Iwanaga, both of Kobe, Japan

[73] Assignee: Sumitomo Rubber Industries, Ltd., Kobe, Japan

[21] Appl. No.: 100,157

[22] Filed: Aug. 2, 1993

[30] Foreign Application Priority Data

Sep. 22, 1992 [JP] Japan ..... 4-072222 U

[51] Int. Cl.[6] ..... A63B 53/04

[52] U.S. Cl. ..... 273/78; 273/167 H; 273/173

[58] Field of Search ..... 273/167 R, 167 H, 171, 273/172, 173, 175, 167 F, 169, 78, 77 R

[56] References Cited

U.S. PATENT DOCUMENTS

| | | | |
|---|---|---|---|
| 550,976 | 12/1895 | Jennings | 273/78 |
| 925,389 | 6/1909 | Royce | 273/78 |
| 1,768,792 | 7/1930 | Schavoir | 273/78 |
| 2,034,936 | 3/1936 | Barnhart | 273/78 |
| 2,846,228 | 8/1958 | Reach | 273/167 F |
| 3,387,844 | 6/1968 | Shippee | 273/167 H X |
| 3,749,408 | 7/1973 | Mills | 273/171 |
| 4,027,885 | 6/1977 | Rogers | 273/173 |
| 4,792,139 | 12/1988 | Nagasaki | 273/173 X |
| 4,811,950 | 3/1989 | Kobayashi | 273/171 |
| 4,848,747 | 7/1989 | Fujimura | 273/167 H X |
| 4,964,640 | 10/1990 | Nakanishi | 273/167 H |
| 5,064,197 | 11/1991 | Eddy | 273/167 H |
| 5,135,227 | 8/1992 | Okumoto | 273/167 H X |
| 5,316,298 | 5/1994 | Hutin | 273/173 |

FOREIGN PATENT DOCUMENTS

| | | | |
|---|---|---|---|
| 124401 | 6/1947 | Australia | 273/78 |

*Primary Examiner*—Sebastiano Passaniti
*Attorney, Agent, or Firm*—Armstrong, Westerman, Hattori, McLeland & Naughton

[57] ABSTRACT

In a metallic golf club head provided with a hollow chamber portion therein, a sheet body having vibration restraining characteristics or a coating material having vibration restraining characteristics is applied to an inner surface portion of a crown portion or other similar portion which is small in thickness. The sheet body or the coating material is 0.05 or above in the loss factor thereof.

12 Claims, 3 Drawing Sheets

GOLF CLUB HEAD

BACKGROUND AND SUMMARY OF THE INVENTION

The present invention relates to a golf club head. In order to make conventional heads for wood type golf clubs, persimmons have been widely used as a material since early times.

On the other hand, in recent years, what is called a metal head comes into use for a wood type golf club, and this conventional metal head is literally made of metal, and is provided with a hollow chamber portion therein. However, some of golfers who make a habitual practice of the use of a persimmon head, and take kindly to a sound emitted from a ball shot thereby have an uncomfortable feeling about a metallic sound produced by and peculiar to a ball shot by the metal head.

That is to say, the metallic sound given by the metal head results from the fact in which the metal head is constructed such that it is provided with a hollow chamber portion.

Therefore, the head of an iron type golf club occasionally produces a peculiar sound at the time of a ball shot thereby if it is provided with a hollow chamber portion.

It is a primary object of the present invention to provide an improved metallic head for a wood type or an iron type golf club, which is capable of preventing a metallic sound peculiar to a ball shot by the conventional metallic club head, even if it is provided with a hollow chamber portion as the conventional metallic club head.

BRIEF DESCRIPTION OF THE DRAWINGS

The present invention will be described with reference to the accompanying drawings, in which.

DETAILED DESCRIPTION OF THE PREFERRED EMBODIMENTS

Several preferred embodiments of the golf club head according to the present invention will be described with reference to FIGS. 1 to 5.

Figure 1:
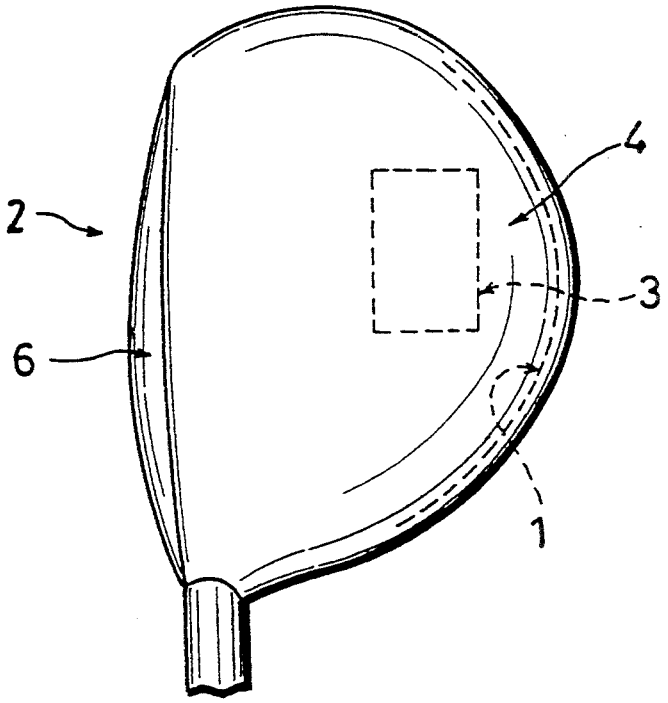
FIG. 1 is a plan view of the golf club head of the present invention according to a first preferred embodiment thereof.
Figure 2:
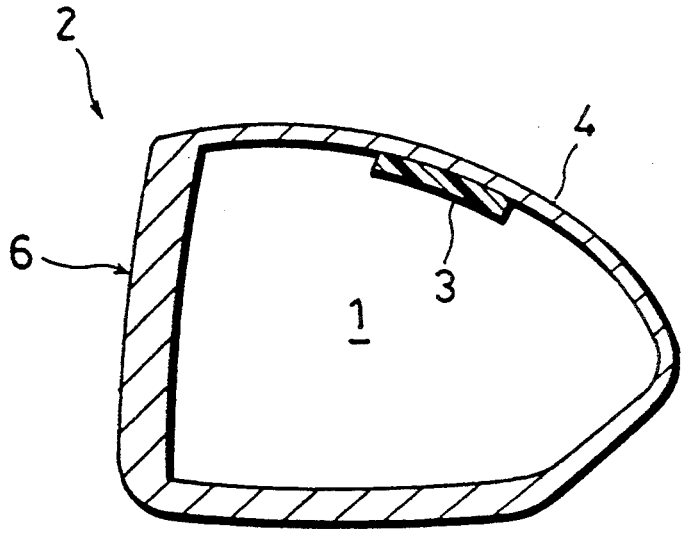
FIG. 2 is a cross sectional view of the golf club head shown in FIG. 1.

In FIG. 1 which shows a plan view of the golf club head according to the first preferred embodiment of the present invention, and also in FIG. 2 which shows a cross sectional view of the golf club head illustrated in FIG. 1, a metallic head 2 for a wood type golf club is provided with a hollow chamber portion 1 therein. This head is generally called a metal head.

A sheet body 3 of sound-attenuating vibration-restraining characteristics is made of a heat setting resin or rubber which has metallic foil arranged thereon. This sheet body 3 is attached to an inner surface portion of the hollow chamber portion 1. It is advisable to attach the sheet body 3 to an inner surface portion of for example, a crown portion 4 or other portion which is relatively small in thickness as the crown portion 4, by using adhesives or other sticking material.

Figure 3:
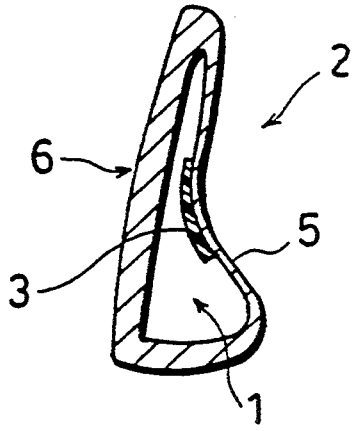
FIG. 3 is a cross sectional view of the golf club head of the present invention according to a second preferred embodiment thereof.

FIG. 3 shows the second preferred embodiment of the present invention, and in this preferred embodiment, the metallic head 2 also provided with the hollow chamber portion 1 therein is for an iron type golf club. The sheet body 3 of sound-attenuating vibration-restraining characteristics is also attached to an inner surface portion of this metallic head 2 by using adhesives or other sticking material. In the club head 2 illustrated in FIG. 3, the sheet body 3 is secured to an inner surface portion of a back face wall portion 5 of the club head 2, which is relatively small in thickness. In connection with FIG. 3, it is parenthetically mentioned that a ball hitting surface of the club head 2 is indicated at the reference numeral 6.

The sheet body 3 may be replaced with a coating material S also furnished with vibration restraining characteristics. That is to say, the coating material S is applied to an inner surface portion of the hollow chamber portion 1. The application of this coating material is feasible to a wider area of the inner surface of the hollow chamber portion 1 than in that of the sheet body 3.

Also, the coating material S can be applied to the entire outer surface of the club head 2 except for the ball hitting surface 6.

The thickness of the coating material S preferably ranges between 1.0 mm and 6.0 mm.

The coating material S or the sheet body 3 is preferably 0.05 or above in the loss factor thereof.

Desirable examples of the coating material S are IDIKELL M-2000 or IDIKELL M-2500 produced by Nihon Tokusyu Toryo Co., Ltd., Japan.

Also, the sheet body 3 is desired to be, for example, IDIKELL M-4000, IDIKELL M-3000, IDIKELL M-3500 produced by Nihon Tokusyu Toryo Co., Ltd. or LEGETOLEX manufactured by Nitoh Denko Co., Ltd.

In the metallic head 2 for a wood type golf club, which is shown in FIG. 1 and 2 as the first preferred embodiment of the present invention, LEGETOLEX produced by Nitoh Denko Co., Ltd. (a synthetic rubber comprising EPDM which has an aluminum foil applied thereto) is formed in a configuration of a square of 10 mm in a side length thereof, and is applied to the crown portion 4 as the vibration restraining sheet body 3 of light weight.

The club head thus obtained is found to be free from the emission of any peculiar metallic sound when a golf ball has been hit thereby.

If the sheet body material is cut to a larger size than specified in the foregoing description, and is applied to an inner surface portion of the hollow chamber portion 1 of the club head, this head is found to prevent the emission of any peculiar metallic sound from a ball shot thereby even if a ball which is greater in the hardness thereof is hit thereby at a higher speed.

Figure 4:
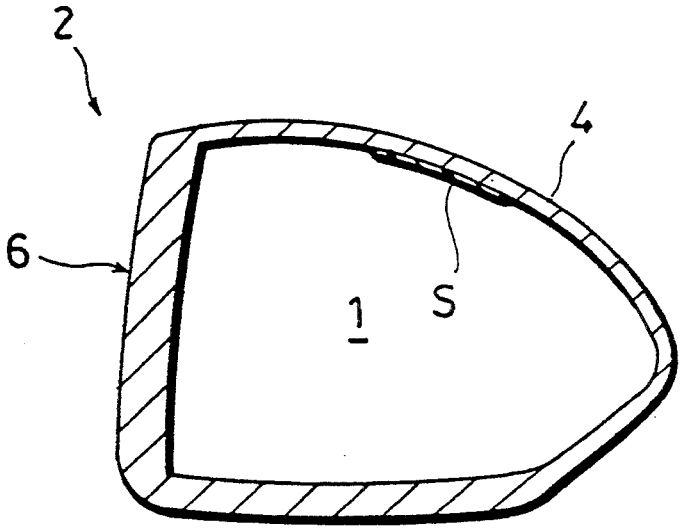
FIG. 4 is a cross sectional view of the golf club head of the present invention according to a third preferred embodiment thereof.
Figure 5:
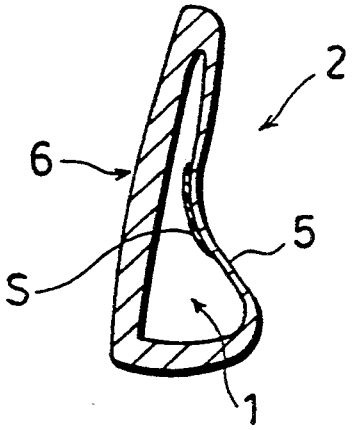
FIG. 5 is a cross sectional view of the golf club head of the present invention according to a fourth preferred embodiment thereof.

In FIG. 4 which shows the third preferred embodiment of the present invention, IDIKELL M-2000, a vibration restraining coating material produced by Nihon Tokusyu Toryou Co., Ltd. is applied to an inner surface portion of the hollow chamber portion 1 which corresponds to the crown portion 4 in a metallic head for a wood type golf club, such that this coating material is 2 mm in thickness when it dries. The metallic head is also capable of extinguishing any peculiar metallic sound from a ball shot thereby.

As is apparent from the foregoing description, in the present invention, any metallic golf club head provided with the hollow chamber portion 1 is capable of reducing or extinguishing a metallic sound peculiar to a ball shot thereby. As a result, the present invention can provide wood type metallic golf clubs which can be used without any uncomfortable feeling about a metallic sound by golfers making a habitual practice of the use of persimmon heads over a long period of time.

Also, as a matter of course, it is feasible to apply the present invention to heads for iron type golf clubs, which are provided with the hollow chamber portions 1.

Moreover, in the present invention, the attachment of the sheet body 3 of vibration restraining characteristics and the application of the vibration restraining coating materials are both easily feasible, and for this reason, the golf club heads according to the present invention can be manufactured at a low cost.

Although the present invention has been fully described by way of examples with reference to the accompanying drawings, it is to be noted here that various changes and modifications will be apparent to those skilled in the art. Therefore, unless otherwise such changes and modifications depart from the scope of the present invention, they should be construed as being included therein.

We claim:

1. A metallic golf club head formed by integrally arranged metal walls defining an enclosed hollow chamber portion, comprising a sheet body having sound attenuating, vibration restraining characteristics, said sheet body forming a layer disposed substantially within the perimeter of one of said walls of said club head and applied to the surface thereof.

2. The golf club head as set forth in claim 1, wherein the loss factor of the sheet body is 0.05 or above.

3. The golf club head as set forth in claim 1, wherein the sheet body comprises in laminated form a heat setting resin and a metallic foil.

4. The golf club head as set forth in claim 1, wherein the sheet body comprises in laminated form a rubber and a metallic foil.

5. The golf club head as set forth in claim 1, wherein said club head includes a crown portion and the sheet body is attached to an inner surface portion thereof.

6. The golf club head as set forth in claim 1, wherein said club head includes a back face wall portion and the sheet body is attached to an inner surface portion thereof.

7. A metallic golf club head formed by integrally arranged metal walls defining an enclosed hollow chamber portion, comprising a layer of coating material having sound attenuating, vibration restraining characteristics disposed substantially within the perimeter of one of said walls of said hollow chamber portion and applied to a surface thereof.

8. The golf club head as set forth in claim 7, wherein the coating material is 0.05 or above in the loss factor.

9. The golf club head as set forth in claim 7, wherein the coating material is 1.0 mm to 6.0 mm in the thickness thereof when said coating material dries.

10. The golf club head as set forth in claim 7, wherein said club head includes a crown portion and the coating material having vibration restraining characteristics is applied to an inner surface portion thereof.

11. The golf club head as set forth in claim 7, wherein said club head includes a back face wall portion and the coating material of vibration restraining characteristics is applied to an inner surface portion thereof.

12. The golf club head as set forth in claim 7, wherein the coating material having vibration restraining characteristics is applied to the portion of the club head other than a ball hitting surface thereof.

* * * * *